US008277262B2

(12) United States Patent
Busse

(10) Patent No.: US 8,277,262 B2
(45) Date of Patent: Oct. 2, 2012

(54) PCB CONNECTOR

(75) Inventor: Ralf-Dieter Busse, Hoppegarten (DE)

(73) Assignee: ADC GmbH, Berlin (DE)

( * ) Notice: Subject to any disclaimer, the term of this patent is extended or adjusted under 35 U.S.C. 154(b) by 150 days.

(21) Appl. No.: 12/739,633

(22) PCT Filed: Oct. 13, 2008

(86) PCT No.: PCT/EP2008/008634

§ 371 (c)(1),
(2), (4) Date: Jul. 19, 2010

(87) PCT Pub. No.: WO2009/052965

PCT Pub. Date: Apr. 30, 2009

(65) Prior Publication Data

US 2010/0304600 A1 Dec. 2, 2010

(30) Foreign Application Priority Data

Oct. 23, 2007 (DE) ..... 10 2007 050 589

(51) Int. Cl.
*H01R 11/20* (2006.01)

(52) U.S. Cl. ..... 439/719; 439/922

(58) Field of Classification Search ..... 439/404, 439/636, 637, 719, 922
See application file for complete search history.

(56) References Cited

U.S. PATENT DOCUMENTS

| | | | | |
|---|---|---|---|---|
| 3,524,161 | A | 8/1970 | Frantz et al. | |
| 4,059,331 | A | 11/1977 | Sedlacek et al. | |
| 4,741,711 | A * | 5/1988 | Singer, Jr. | 439/620.26 |
| 5,419,715 | A * | 5/1995 | Laveissiere | 439/491 |
| 7,050,571 | B1 | 5/2006 | Mars et al. | |
| 7,192,307 | B1 * | 3/2007 | Tran et al. | 439/553 |
| 7,270,551 | B2 * | 9/2007 | Busse et al. | 439/76.1 |
| 7,407,389 | B2 * | 8/2008 | Busse et al. | 439/76.1 |
| 7,410,369 | B2 * | 8/2008 | Busse et al. | 439/76.1 |
| 7,591,654 | B2 * | 9/2009 | Neumetzler | 439/79 |
| 7,722,404 | B2 * | 5/2010 | Neumetzler | 439/636 |
| 7,762,833 | B2 * | 7/2010 | Neumetzler | 439/404 |
| 7,936,572 | B2 * | 5/2011 | Busse et al. | 361/827 |
| 8,016,617 | B2 * | 9/2011 | Neumetzler | 439/620.08 |
| 8,043,110 | B2 * | 10/2011 | Busse et al. | 439/404 |
| 2005/0064760 | A1 | 3/2005 | Ma | |
| 2009/0130890 | A1 | 5/2009 | Neumetzler | |
| 2010/0304583 | A1 * | 12/2010 | Busse | 439/76.1 |
| 2010/0304600 | A1 * | 12/2010 | Busse | 439/404 |

FOREIGN PATENT DOCUMENTS

| | | | |
|---|---|---|---|
| DE | 199 45 412 | | 3/2000 |
| DE | 101 11 571 | | 10/2002 |
| DE | 102 57 308 | | 7/2004 |
| DE | 103 39 844 | | 1/2005 |
| DE | 10 2004 054 535 | | 3/2006 |
| GB | 2 350 944 | | 12/2000 |
| WO | WO 98/13902 | | 4/1998 |
| WO | WO 2005/051006 | | 6/2005 |
| WO | 2006/048220 | * | 5/2006 |

* cited by examiner

*Primary Examiner* — Neil Abrams
(74) *Attorney, Agent, or Firm* — Merchant & Gould P.C.

(57) ABSTRACT

The invention relates to a PCB connector (1), comprising a housing (2) and a plurality of contact elements (3), every contact element (3) having a contact for connection to wires and a contact for connection to a printed circuit board. housing (2) is configured as one piece, the contact elements (3) being captively snap-locked in the housing (2).

19 Claims, 5 Drawing Sheets

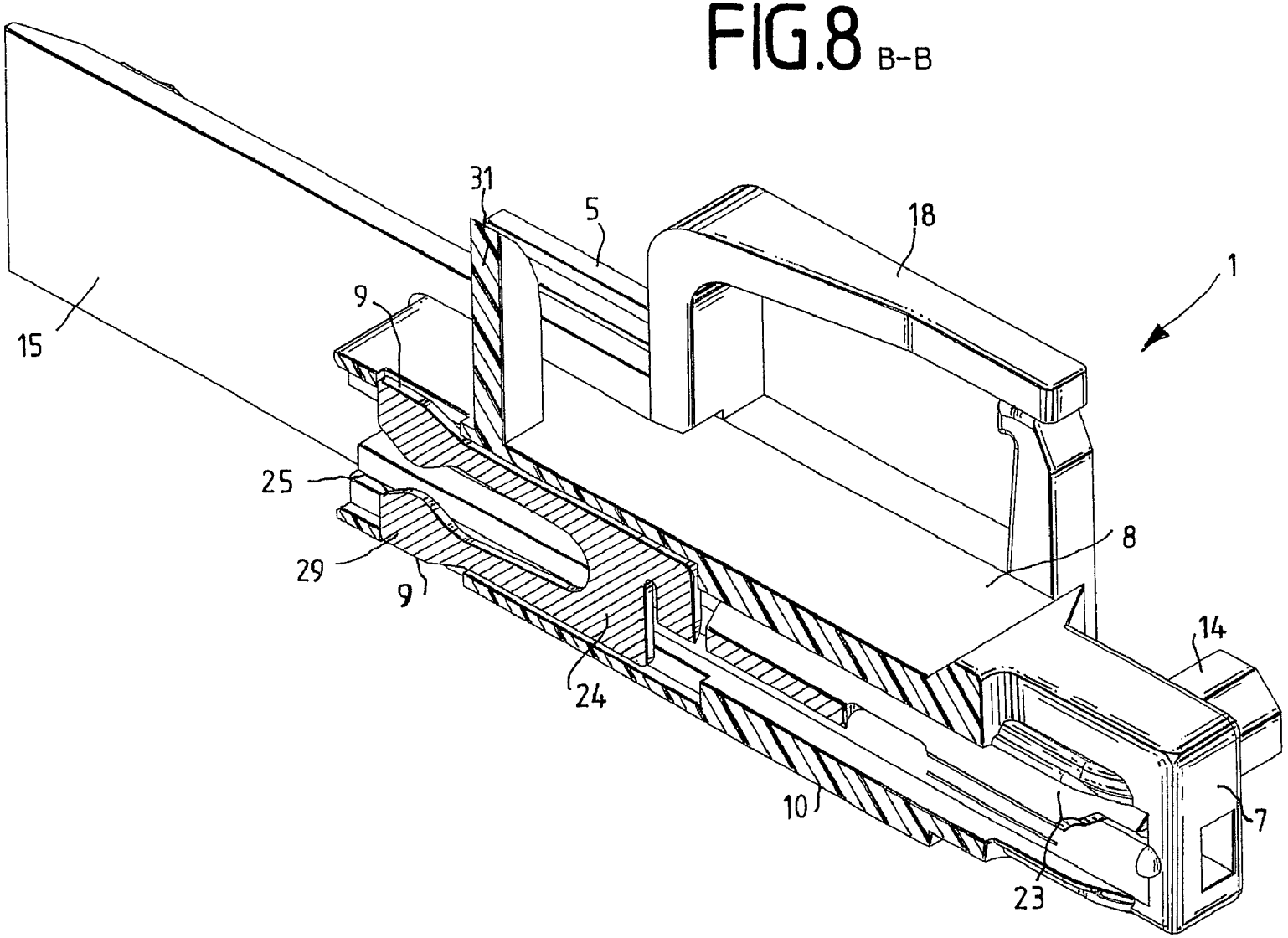
FIG.8 B-B

PCB CONNECTOR

This application is a National Stage Application of PCT/EP2008/008634, filed 13 Oct. 2008, which claims benefit of Ser. No. 10 2007 050 589.4, filed 23 Oct. 2007 in Germany and which applications are incorporated herein by reference. To the extent appropriate, a claim of priority is made to each of the above disclosed applications.

BACKGROUND

The invention relates to a plug-type printed circuit board connector, comprising a housing and a number of contact elements, each contact element comprising a contact for connecting wires and a contact for connection to a printed circuit board.

DE 102 57 308 B3 has disclosed a plug-type connector for printed circuit boards, comprising a number of contact elements, the contact elements each having two connection sides, one connection side being in the form of an insulation displacement contact for connecting wires and the other connection side being in the form of a fork contact for making contact with connection pads on a printed circuit board, and a plastic housing, into which the insulation displacement contacts of the contact elements can be inserted, the insulation displacement contact and the fork contact being arranged such that they are rotated with respect to one another and at least one lower edge of the insulation displacement contact being supported on the plastic housing, so that the contact elements are held captively in the plastic housing in the event of connection forces occurring on the insulation displacement contacts, the plastic housing comprising at least one chamber-shaped region, and the fork contacts being accommodated completely in the longitudinal direction of the plastic housing, ribs being arranged in the chamber-shaped region on the inner sides, which ribs define guides for the fork contacts, the contact regions of the fork contacts protruding beyond the ribs, and the ribs being beveled in the front region. In this case, the housing has a two-piece design, the housing parts being latched to one another.

SUMMARY

The invention is based on the technical problem of providing a plug-type printed circuit board connector of the generic type which has a simpler design.

In this regard, the plug-type printed circuit board comprises a housing and a number of contact elements, each contact element comprising a contact for connecting wires and a contact for connection to a printed circuit board, the housing being designed to be integral, and the contact elements being latched captively in the housing. This results in a simple and compact design of the plug-type connector since the housing can be produced, for example, in one method step using injection-molding technology. As a result, necessary physical specifications for latching or the like on the housing no longer need to be adhered to.

In a preferred embodiment, the housing has slots on the upper side and the lower side, into which slots enlarged portions of the contact elements engage. Since the housing is produced from plastic, it has a certain spring action, with the result that, when the contact elements are inserted, they are loaded slightly, but bend the plastic of the housing away until the enlarged portions latch into the slots. Instead of the slots, the housing can also have projections, behind which the contact elements latch in when inserted.

Preferably, the enlarged portions are arranged on the contact for connecting the printed circuit board. In an embodiment with projections, these projections are preferably arranged in such a way that the contact for connecting the wires latches behind the projection.

In a further preferred embodiment, the contact for connecting the wires is in the form of an insulation displacement contact and/or the contact for connecting the printed circuit board is in the form of a fork contact.

In a further preferred embodiment, the insulation displacement contact is rotated through 45° with respect to the fork contact, the rotation taking place about the longitudinal axis of the contact element.

In a further preferred embodiment, connecting elements are arranged on the side faces of the housing.

In a further preferred embodiment, side parts are arranged on the connecting elements, which side parts further preferably have a cable guide and/or an interface for connection to a module housing. In this case, the side parts can have different designs, depending on the application. In principle, it is also possible for further housings to be connected to the connecting elements using contact elements, so that the possibility of a modularly extendable plug-type printed circuit board connector is provided. It is further possible for the side parts with the interface and/or the cable guide to be designed to be integral with the housing. This is advantageous, for example, when the flexibility in terms of the interface and/or cable guide is not required since the complete plug-type printed circuit board connector then only comprises a single plastic part with the contact elements.

In a further preferred embodiment, the interface for connection to a module housing is arranged on the outer sides of the side parts.

In a further preferred embodiment, the interface comprises a ramp-shaped element, above and below which in each case one latching element is arranged, the latching elements being flatter than the highest elevation of the ramp-shaped element. As a result, the highest elevation of the ramp-shaped element forms a defined pressure point, which juts out during the insertion into a module housing, so that, as a result of pressure on the ramp-shaped elements, the interfaces are pressed inwards and unlatch the latching elements.

In a further preferred embodiment, the connecting elements on the side faces of the housing are in the form of a drilled hole with a lateral slot, the width of the slot being smaller than the diameter of the drilled hole.

In this case, the corresponding connecting elements on the side parts are in the form of cylinder pins, which have a larger circular head. For connection purposes, the head is then pushed through the drilled hole and subsequently the cylinder pin is moved in the slot, which results in a type of locking via the head part. In principle, however, other embodiments for the connecting elements are also conceivable, for example simple holes, into which journals are plugged.

In a further preferred embodiment, a cover, which is at right angles to the upper side, is arranged on the upper side of the housing. The cover is primarily used as a mechanical protection means for the elements on the printed circuit board.

In a further preferred embodiment, in each case one pin-shaped element is arranged on the side faces of the housing, the pin-shaped elements forming the pivot bearing of a nameplate frame. The pin-shaped element in this case preferably has a polygonal cross section, preferably a hexagonal cross section. This results in latching between the nameplate frame and the pin-shaped element, so that the nameplate frame independently remains in a folded-up position.

BRIEF DESCRIPTION OF THE DRAWINGS

The invention will be explained in more detail below with reference to a preferred exemplary embodiment. In the figures:

FIG. 8 shows a sectional illustration through the plug-type printed circuit board connector along the section B-B.

DETAILED DESCRIPTION

Figure 1:
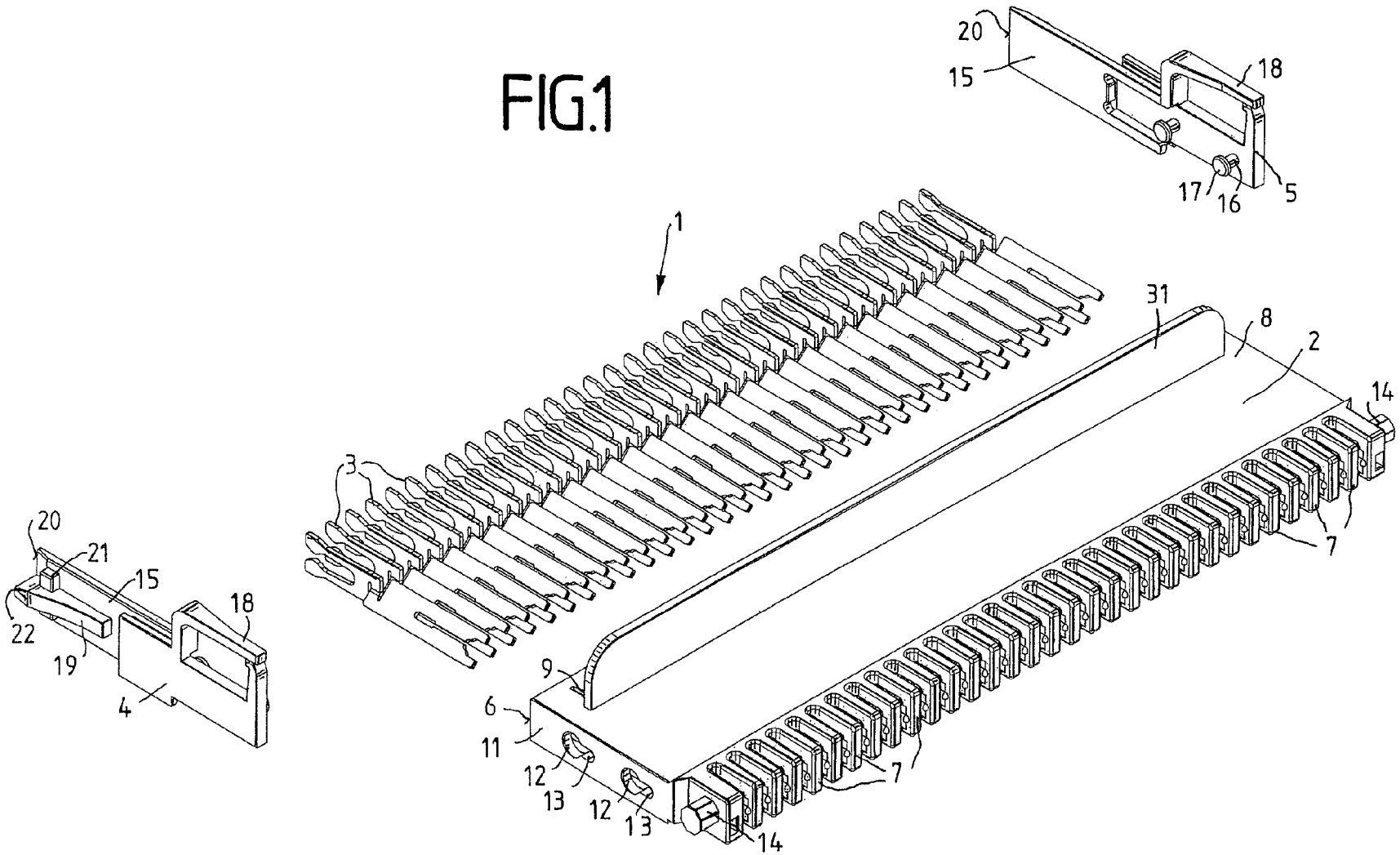
FIG. 1 shows an exploded illustration of a plug-type printed circuit board connector.
Figure 2:
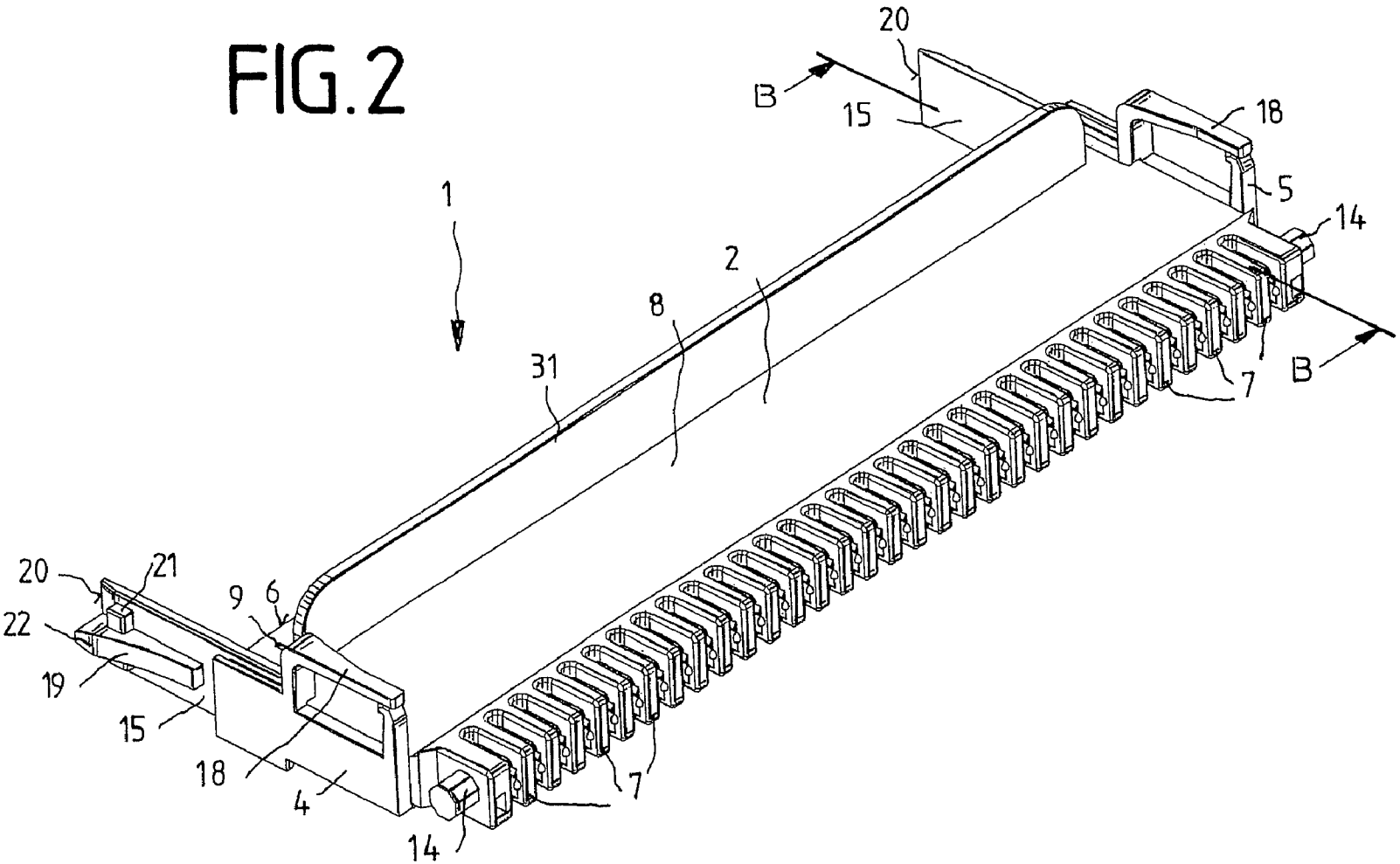
FIG. 2 shows a perspective plan view of an assembled plug-type printed circuit board connector.
Figure 3:
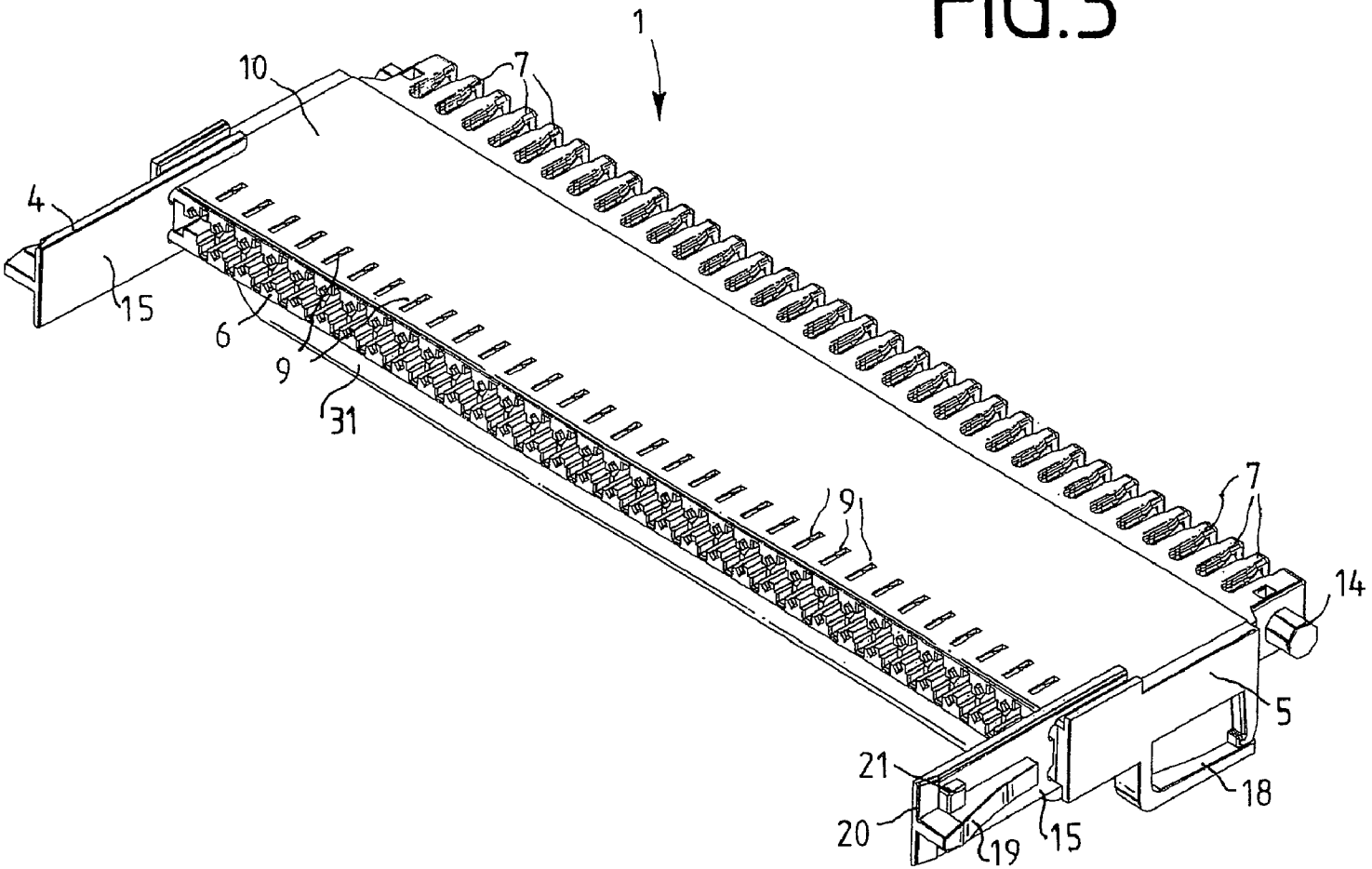
FIG. 3 shows a perspective view from below of the plug-type printed circuit board connector.
Figure 4:
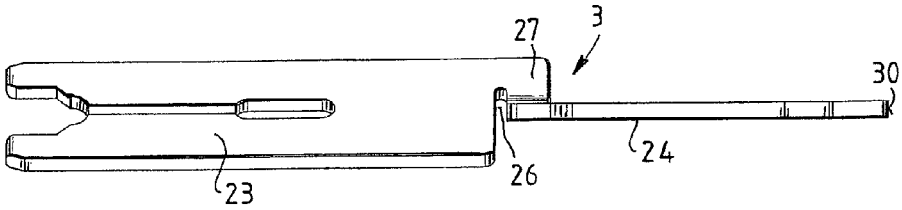
FIG. 4 shows a first perspective side view of a contact element.
Figure 5:
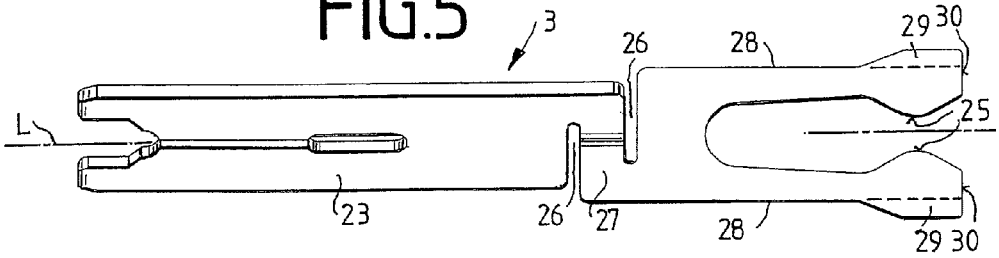
FIG. 5 shows a second perspective side view of the contact element.
Figure 6:
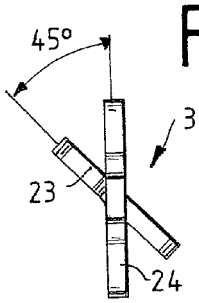
FIG. 6 shows a plan view of the contact element.
Figure 7:
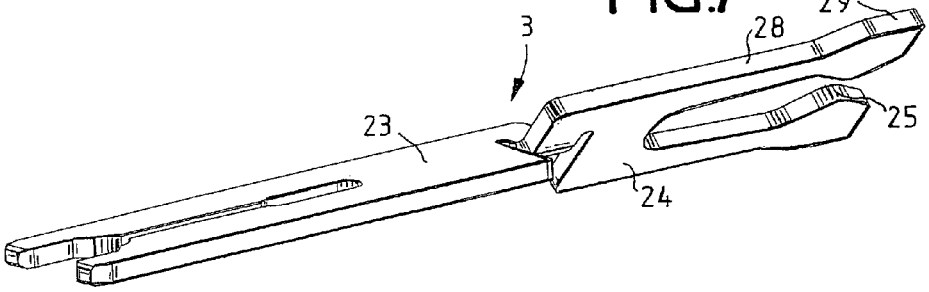
FIG. 7 shows a third perspective view at an angle.

The plug-type printed circuit board connector 1 comprises an integral housing 2 made from plastic, a number of contact elements 3 and two side parts 4, 5. The housing 2 is formed in the interior with guides (not illustrated) in which the contact elements are guided in a defined manner. The housing 2 is designed in terms of its depth in such a way that the contact elements 3 are completely accommodated (see also FIG. 8). For this purpose, the contact elements 3 are pushed into the housing 2 from the lower, open end side 6. Domes 7 are arranged on the upper end side of the housing 2, between which domes the contact elements 3 lie. A cover 31, which extends virtually over the entire width of the housing 2 and is arranged at right angles to the upper side 8, is arranged on an upper side 8 of the housing 2. Slots 9 are incorporated into the housing 2 on the upper side 8 and a lower side 10 (see FIG. 3) of the housing 2. The number of slots 9 in the upper side 8 or the lower side 10 corresponds to the number of contact elements 3. In the example illustrated, the housing 2 is used for accommodating thirty-two contact elements 3. The slots 9 in the upper side 8 are in this case aligned with the slots 9 in the lower side 10. Drilled holes 12 with a lateral slot 13 are arranged on the side faces 11 of the housing 2. In this case, the width of the slot 13 is slightly smaller than the diameter of the drilled hole 12. Furthermore, pin-shaped elements 14, which have a hexagonal cross section and are used as the pivot bearing of a nameplate frame (not illustrated), are arranged on the side faces 11 or the outer sides of the two last domes 7. The side parts 4, 5 each have a lug-shaped basic body 15. In each case two pin-shaped elements 16 with a wider, circular head part 17 are arranged on the inner sides of the lug-shaped basic body 15. In order to connect the side parts 4, 5 to the housing 2, the head parts 17 are plugged into the drilled hole 12 and then the side part 4, 5 is moved in the direction of the domes 7, the pin-shaped elements 16 running along in the slot 13. The head part 17, which lies behind this and is wider than the slot 13, then prevents the side part 4, 5 from being capable of being withdrawn. The side parts 4, 5 furthermore have a cable guide 18, whose geometry can be matched to the requirements in situ. The plug-type printed circuit board connector 1 can therefore be matched optimally to the conditions by using various side parts 4, 5. A ramp-shaped element 19, which extends as far as an end side 20 of the lug-shaped basic body 15, which end side 20 is opposite the cable guide 18, is arranged on the outer sides of the lug-shaped basic body 15. In each case one latching element 21, which in the example illustrated is parallelepipedal, is arranged above and below the ramp-shaped element 19. In this case, the latching element 21 is flatter than the highest elevation 22 of the ramp-shaped element 19 and further preferably is also not higher than any point on the ramp-shaped element 19.

The contact element 3 will now be explained in more detail with reference to FIGS. 4 to 7. The integral contact element 3 comprises an insulation displacement contact 23 for connecting wires and a fork contact 24 for connection to a printed circuit board. In this case, contact regions 25 of the fork contact 24 come into contact with metallized pads on the printed circuit board. In the longitudinal direction L, the fork contact 24 and the insulation displacement contact 23 are rotated through 45° with respect to one another, which can best be seen in FIG. 6. For this purpose, the contact element 3 has notches 26, so that a flexible web 27 results. The fork contact 24 has enlarged portions 29 on the outer sides 28 thereof, which enlarged portions are at the level of the contact regions 25 and extend as far as the end side 30 of the fork contact 24. When the contact element 3 is inserted into the housing 2, the enlarged portions 29 slide into the slots 9 of the upper side 8 and lower side 10, so that the contact elements 3 are latched captively in the housing 2. This latched state can best be seen in FIG. 8.

LIST OF REFERENCE SYMBOLS

1 Plug-type printed circuit board connector
2 Housing
3 Contact elements
4, 5 Side parts
6 End side
7 Dome
8 Upper side
9 Slots
10 Lower side
11 Side face
12 Drilled holes
13 Slots
14 Pin-shaped elements
15 Basic body
16 Pin-shaped elements
17 Head part
18 Cable guide
19 Ramp-shaped element
20 End side
21 Latching element
22 Highest elevation
23 Insulation displacement contact
24 Fork contact
25 Contact regions
26 Notches
27 Flexible web
28 Outer side
29 Enlarged portions
30 End side
31 Cover
L Longitudinal direction

The invention claimed is:

1. A plug-type printed circuit board connector, comprising:

a housing and a number of contact elements, each contact element including a contact for connecting wires and a contact for connection to a printed circuit board, wherein the housing is designed to be integral, the contact elements being latched captively in the housing, wherein connecting elements are arranged on side faces of the housing, wherein separately formed side parts are arranged on the connecting elements; and wherein the side parts have a cable guide and an interface for connection to a module housing.

2. A plug-type printed circuit board connector as claimed in claim 1, wherein the housing has slots on the upper side and on the lower side, into which slots enlarged portions of the contact elements engage.

3. The plug-type printed circuit board connector as claimed in claim 2, wherein the enlarged portions are arranged on the contact for connecting the printed circuit board.

4. The plug-type printed circuit board connector as claimed in claim 1, wherein the contact for connecting the wires is in the form of an insulation displacement contact and the contact for connecting the printed circuit board is in the form of a fork contact.

5. The plug-type printed circuit board connector as claimed in claim 4, wherein the insulation displacement contact is rotated through 45° with respect to the fork contact.

6. The plug-type printed circuit board connector as claimed in claim 1, wherein the interface for connection to a module housing is arranged on the outer sides of the side parts.

7. The plug-type printed circuit board connector as claimed in claim 1, wherein the interface comprises a ramp-shaped element, above and below which in each case one latching element is arranged, the latching elements being flatter than the highest elevation of the ramp-shaped element.

8. The plug-type printed circuit board connector as claimed in claim 1, wherein the connecting elements on the side faces of the housing are in the form of a drilled hole with a lateral slot, the width of the slot being smaller than the diameter of the drilled hole.

9. The plug-type printed circuit board connector as claimed in claim 1, wherein a cover, which is at right angles to the upper side, is arranged on the upper side of the housing.

10. The plug-type printed circuit board connector as claimed in claim 1, wherein in each case one pin-shaped element is arranged on the side faces of the housing, the pin-shaped elements forming the pivot bearings of a name-plate frame.

11. The plug-type printed circuit board connector as claimed in claim 10, wherein the pin-shaped elements have a polygonal cross section.

12. A plug-type printed circuit board connector, comprising:

a housing and a number of contact elements, each contact element including a contact for connecting wires and a contact for connection to a printed circuit board, wherein the housing is designed to be integral, the contact elements being latched captively in the housing, wherein connecting elements are arranged on side faces of the housing, wherein the connecting elements on the side faces of the housing are in the form of a drilled hole with a lateral slot, the width of the slot being smaller than the diameter of the drilled hole.

13. A plug-type printed circuit board connector as claimed in claim 12, wherein the housing has slots on the upper side and on the lower side, into which slots enlarged portions of the contact elements engage.

14. The plug-type printed circuit board connector as claimed in claim 13, wherein the enlarged portions are arranged on the contact for connecting the printed circuit board.

15. The plug-type printed circuit board connector as claimed in claim 12, wherein the contact for connecting the wires is in the form of an insulation displacement contact and the contact for connecting the printed circuit board is in the form of a fork contact.

16. The plug-type printed circuit board connector as claimed in claim 15, wherein the insulation displacement contact is rotated through 45° with respect to the fork contact.

17. The plug-type printed circuit board connector as claimed in claim 12, wherein a cover, which is at right angles to the upper side, is arranged on the upper side of the housing.

18. The plug-type printed circuit board connector as claimed in claim 12, wherein in each case one pin-shaped element is arranged on the side faces of the housing, the pin-shaped elements forming the pivot bearings of a name-plate frame.

19. The plug-type printed circuit board connector as claimed in claim 18, wherein the pin-shaped elements have a polygonal cross section.

* * * * *